US005380003A

United States Patent [19]

Lanctot

[11] Patent Number: 5,380,003

[45] **Date of Patent: * Jan. 10, 1995**

[54] BASEBALL BAT

[76] Inventor: Paul A. Lanctot, 520 Sand Hill Rd., Scotts Valley, Calif. 95066

[ * ] Notice: The portion of the term of this patent subsequent to Jan. 19, 2010 has been disclaimed.

[21] Appl. No.: 180,535

[22] Filed: Jan. 12, 1994

Related U.S. Application Data

[63] Continuation-in-part of Ser. No. 5,007, Jan. 15, 1993, abandoned.

[51] Int. Cl.[6] ..... A63D 59/06

[52] U.S. Cl. ..... 273/72 R; 273/72 A

[58] Field of Search ..... 273/72 R, 72 A, 26 B, 273/170, 67 A, 73 B, 73 J, 67 R; 81/22

[56] References Cited

U.S. PATENT DOCUMENTS

| | | | |
|---|---|---|---|
| 3,727,295 | 4/1973 | Gildemeister | 273/72 A |
| 4,182,512 | 1/1980 | Kuebler | 273/736 |
| 4,330,125 | 5/1982 | Sassler | 273/736 |
| 4,541,631 | 9/1985 | Sasse | 273/170 |
| 5,180,163 | 1/1993 | Lanctot | 273/72 R |
| 5,183,264 | 2/1993 | Lanctot | 273/624 |
| 5,219,164 | 6/1993 | Peng | 273/72 R |

*Primary Examiner*—Mark S. Graham
*Attorney, Agent, or Firm*—Jeffrey A. Hall

[57] ABSTRACT

A baseball bat made of a rigid material and having an elongated body with a free end tapering to a handle of a reduced diameter includes a cavity within the handle adapted to secure and receive a tubular member therein, a detachable knob with a chamber therein is secured within the cavity of the handle and to a tubular member inserted into the handle cavity. The tubular member includes a plurality of particles interiorly disposed therein, and a fluid interiorly situated within the tubular member. The tubular member is preferably secured to the detachable knob by one or more grooves, ridges, threads, or barbs on a inner surface of the detachable knob which mate with a corresponding set of grooves, ridges, threads or barbs, on a outer surface of the tubular member. The detachable knob is preferably secured to the handle by one or more grooves, ridges, threads, or barbs on the detachable knob mating with a corresponding set of grooves, ridges, threads, or barbs on a inner surface of the handle. A transfer cylinder may be attached to the tubular member by an elongated rod allowing for even greater shock dampening effects.

14 Claims, 3 Drawing Sheets

BASEBALL BAT

"This is a continuation-in-part of copending application(s) Ser. No. 08/005,007 filed on Jan. 15, 1993 abandoned."

TECHNICAL FIELD

This invention relates to ball bats, particularly to baseball bats having means to dampen and isolate shock components generated as a result of the impact when the bat strikes a ball.

BACKGROUND ART

Baseball bats, racquets, paddles and clubs are all commonly used in various sports where the object is to strike a moving or stationary ball in order to propel it some distance. These devices have certain problems in common as well as common objectives. A primary problem is the generation of a shock as a result of the impact of the ball with the bat, or racquet, or club, etc.

In a baseball bat the shock generated is most severe when the ball impacts a point other than the optimum striking point or "sweet spot" on the bat. The "sweet spot" is the point where the most impact energy will be delivered to the ball and the bat rebounds straight back and opposite to the ball's line of flight, and without any torquing, end for end, as rotation is developed. When this point is missed, some of the impact energy is delivered to the bat, off center, causing the bat to rotate, end for end, which results in both uncomfortable and injurious levels of shock being transmitted through the bat handle to the athlete. At best, this painful shock can rob the athlete of confidence and at worst, it can cause serious injury.

A significant advance in shock resistant baseball bats was disclosed in U.S. Pat. No. 5,180,163 issued to the present inventor Jan. 19, 1993. In this patent a baseball bat was disclosed having significant shock dampening capabilities including a tube member secured within the handle of the bat and having a spine member surrounded by a fluid. Such bat is highly efficient at dampening shock without adversely affecting the ball propulsion function of the bat.

Other baseball bats have been proposed and implemented which have attempted to dampen such shock and their consequences, albeit, all with significant limitations. Such limitations are undoubtedly a reason these bats have not received widespread acceptance.

For example, one such bat is disclosed in U.S. Pat. No. 4,951,948 issued to Peng where a cylindrical handle and main body are connected together and held by a retaining collar and an elastic ring. An elastic connector is provided axially attached to an end piece. Such shock absorbing bat did not provide for any relief from end torsional shock which is a primary factor for discomfort and injury, nor did such bat provide relief from the backwards reaction shock without diminution of the forward striking force which is directly and principally involved in propelling the ball.

Another genre of bat is disclosed in U.S. Pat. No. 4,898,386 issued to Anderson, where a training bat consisted of a hollow cylindrical bat having a disk positioned in the interior of the bat near its center. A plate was also positioned in the interior of the bat and an object was slideably positioned in the interior of the bat and was moveable between the disk and the plate. A hollow chamber having a knob is positioned at the handle end of the bat. Such bat had limited applications as a training device but was not useful in actual sport, nor did it provide adequate shock dampening functions.

Still another type of bat is disclosed in U.S. Pat. No. 3,955,816 issued to Bratt, where a warm-up bat having a hollow chamber with granular weight material distibuted therein to result in a practice ball bat with a distributed weight or bat-like feel. The handle section of such bat telescoped into one end of the tubular section filled with an aggregate of flowable material, such as sand. Such bat was not useable in actual sport as it had a deadening effect on the ball, and provided little, if any relief from the shock component responsible for discomfort and injury.

It would be highly desirable therefore to provide a means and method to specifically reduce the destructive shock generated by a bat after striking a ball while leaving the ball propulsion function of the bat essentially unchanged.

SUMMARY OF THE INVENTION

In accordance with the present invention, a baseball bat is provided comprising an elongated body with a free end or impact portion of one diameter tapering to a handle portion of reduced diameter, said handle portion having an outer surface an an inner surface, and a cavity therein; the handle portion including a detachable knob adapted to be secured in said cavity in the handle portion; said detachable knob having an extended portion and an elongated portion, said elongated portion including a chamber therein; the elongated portion of the detachable knob having an outer surface and an inner surface; a tubular member having an outer surface an inner surface inserted into said handle portion of said ball bat and includes a first end and a second end, said first end having an opening therein and includes means for securing said tubular member to said detachable knob; a plurality of particles interiorly disposed within said tubular member; and a fluid interiorly situated within said tubular member.

The means for securing said tubular member to said detachable knob comprises one or more grooves, ridges, projections, threads, and the like, within said chamber of said detachable knob and a corresponding set of ridges, grooves, threads, and the like, on the outer surface of said tubular member for coupling with said plurality of grooves, ridges, threads, etc., within the chamber of the detachable knob.

The baseball bat may further include one or more ridges, grooves, threads, and the like on the outer surface of the elongated portion of the detachable knob for coupling with one or more grooves, threads, ridges, and the like, on the inner surface of the handle.

The tubular member is preferably cylindrical is shape and may be composed of plastic, metal, rubber, urethane, and the like.

The particles may be of any shape e.g. granular, flakes, particulate, etc., and may be composed of a metal, plastic, composite, and the like. The particles are combined in the tubular member with a viscous fluid, such as oil, or other fluid, and dampen shock components generated when the bat strikes a ball.

The present invention provides a baseball bat and a method of modifying existing baseball bats by use of the above so as to dampen and isolate both the torquing and lengthwise shocks generated by inaccurate hits while having essentially no effect on the third shock component which is perpendicular to the long axis of the bat, and generally concentrated by weight distribution in the impact section of the bat and parallel to the line of flight of the ball.

In baseball or softball an accurate hit occurs when the bat to ball contact point is directly on what is called, in the sport, "the sweet spot". An engineering term for this point is the radius of gyration. The radius of gyration is the point on a swinging bat which has the average moment of inertia for all components involved in the swinging of the bat. This not only includes the bat, but also a portion of the inertia of the athlete's arms and torso, limited by the rigidity of the athlete's grip. The rotational axis of this moment of inertia is typically through the center of the athlete's body. The precise location of this point is defined by the equation:

$$I/M=K\wedge 2$$

Where:

I is the moment of inertia.

M is the mass.

K is the radius of gyration from the axis of rotation.

The radius of gyration is therefore dependent not only on the bat, but also on the way the bat is swung. This virtually assures that shock generated by a hit not on this point or "sweet spot" will be a routine occurrence.

The present invention, by providing a bat having a detachable knob secured directly to a tubular member having a slurry of particles and fluid therein, and the tubular member being securely situated in the handle of the bat, reacts specifically to high amplitude shocks delivered at the handle of the bat and to any shock acting perpendicular to the handle. This device does not adversely affect the flight of the ball as it specifically attenuates the shock which would normally be painfully absorbed by the athlete's hands, wrists and elbows. The device may be retro-fitted onto existing bats or may be simply manufactured as a new bat. Additionally, by adding a weight such as the tubular member of the present invention to the handle of the bat, the bat speed is increased.

Other advantages and a fuller understanding of the invention will be had by referring to the following description and claims of a preferred embodiment thereof taken in conjunction with the accompanying drawings wherein like reference numerals refer to similar parts throughout the several views.

BRIEF DESCRIPTION OF DRAWINGS

The details of my invention will be described in connection with the accompanying drawings, which are incorporated in and constitute a part of the specification and illustrate a preferred embodiment of the invention and, together with a general description given above and the detailed description of the preferred embodiment given below, serve to explain the principles of the invention.

DETAILED DESCRIPTION OF THE PREFERRED EMBODIMENT OF THE INVENTION

Although specific terms are used in the following description for the sake of clarity, these terms are intended only to refer to the particular structure of the invention elected for illustration and are not intended to define or limit the scope of the invention.

Reference will now be made in detail to the present preferred embodiment of the invention as illustrated in the accompanying drawings.

In accordance with the present invention, there is provided a ball bat, comprising: an elongated body with a free end portion of one diameter tapering to a handle portion of reduced diameter, said handle portion having an outer surface and an inner surface and a cavity therein; the handle portion including a detachable knob adapted to be secured with said cavity in the handle portion; said detachable knob having and expanded portion and an elongated portion, said elongated portion including a chamber therein; the elongated portion of the detachable knob having an outer surface and an inner surface; a tubular member having an outer surface and an inner surface inserted into said handle portion of said ball bat and includes a first end and a second end, said first end having an opening therein and includes means for securing said tubular member to said detachable knob; a plurality of particles interiorly disposed within said tubular member; and a fluid interiorly situated within said tubular member.

There is also provided, in accordance with the invention, a ball bat comprising: an elongated body with a free end portion of one diameter tapering to a handle portion of a reduced diameter, said handle portion having an outer surface and an inner surface and a cavity therein; the handle portion including a detachable knob adapted to be secured in said cavity in the handle portion; said detachable knob having an expanded portion and an elongated portion, said elongated portion including a chamber therein; the elongated portion of the detachable knob having an outer surface and an inner surface; a tubular member having an outer surface an an inner surface inserted into said handle portion of said bat and includes a first end and a second end, said first end having an opening therein and includes means for securing said tubular member to said detachable knob; a transfer cylinder operably inserted into said free end portion of said elongated body; said transfer cylinder being attached to the tubular member by fastening means; a plurality of particles interiorly disposed withins said tubular member; and a fluid interiorly situated within said tubular member.

Figure 1:
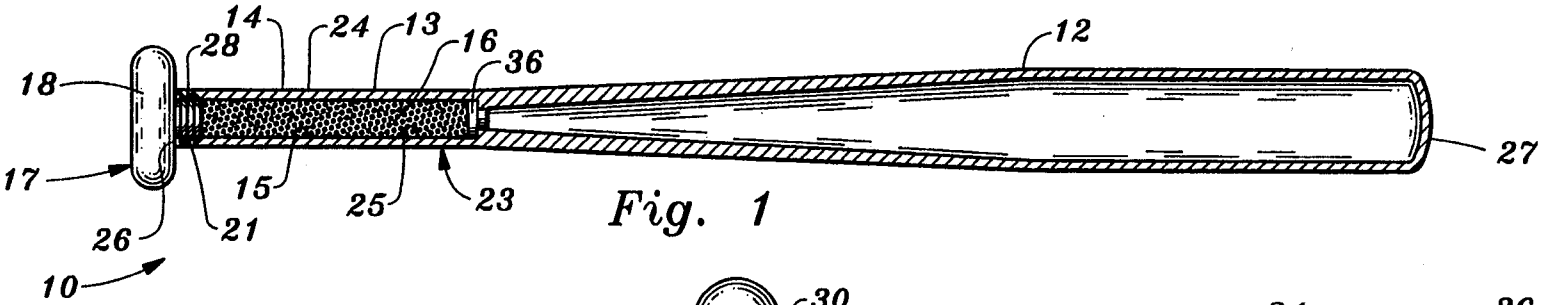
FIG. 1 is a side cross-sectional view of a baseball bat constructed in accordance with the teachings of the present invention.

In FIG. 1 the ball bat 10 is shown as with a free end portion 12 of one diameter tapering to a handle portion 13 of reduced diameter. The handle portion has an outer surface 14, an inner surface 15, and a cavity 16 therein. The handle portion 13 includes a detachable knob 17 adapted to be secured within said cavity 16 in the handle portion 13. Detachable knob 17 preferably has an expanded portion 18 and an elongated portion 19. The elongated portion 19 includes a chamber 20 therein, and has an outer surface 21 and an inner surface 22.

Figure 2:
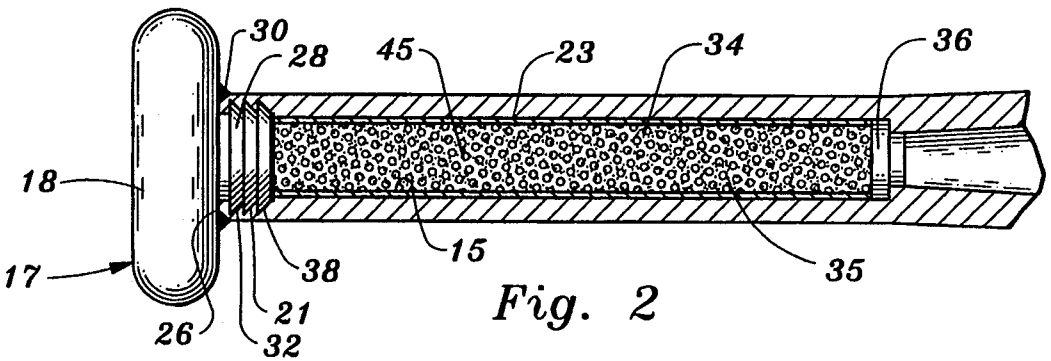
FIG. 2 is an enlarged partial, cross-sectional view corresponding to the handle area of such baseball bat, according to the invention.

As shown in FIG. 1 and 2 a tubular member 23 having an outer surface 24 and an inner surface 25 is inserted into handle portion 12 of ball bat 10, and includes a first end 26 and a second end 27. First end 26 has an opening 28 therein and includes means for securing said tubular member 23 to said detachable knob 17. A plurality of particles 34 are interiorly disposed within said tubular member as well as a fluid 35 interiorly situated within said tubular member comprising a slurry 45. Particles 34 may be composed of metal, plastic, composites, and the like, and be any shape, such as round, square, triangular, flake-like etc. A preferred configuration for particles 34 is jack-shaped or star-shaped, that is particles 34 including projections 39 radiating therefrom. Particles 34 may be packed in tubular member 23 in a freely flowable concentration, or be more densely packed thereby limiting their movement. Fluid 35 is preferably a viscous fluid, such as an oil, but any flowable liquid or fluid may be used.

The preferred means for securing tubular member 23 to detachable knob 17 comprises one or more grooves 30, which may alternatively be ridges, threads, barbs, and the like, within said chamber 20 on inner surface 22 of detachable knob 17. A corresponding set of ridges 31, which may alternatively be grooves, threads, barbs, and the like, are configured on outer surface 24 of tubular member 23 for coupling with said plurality of grooves 30 within chamber 20 of detachable knob 17 best seen in FIGS. 1 and 2. A wide range of combinations of such grooves and ridges may be used, for example, if ridges are substituted for grooves 30 on the inner surface of detachable knob 17 then a corresponding set of grooves or threads will be employed on the outer surface 24 of tubular member 23.

Figure 3:
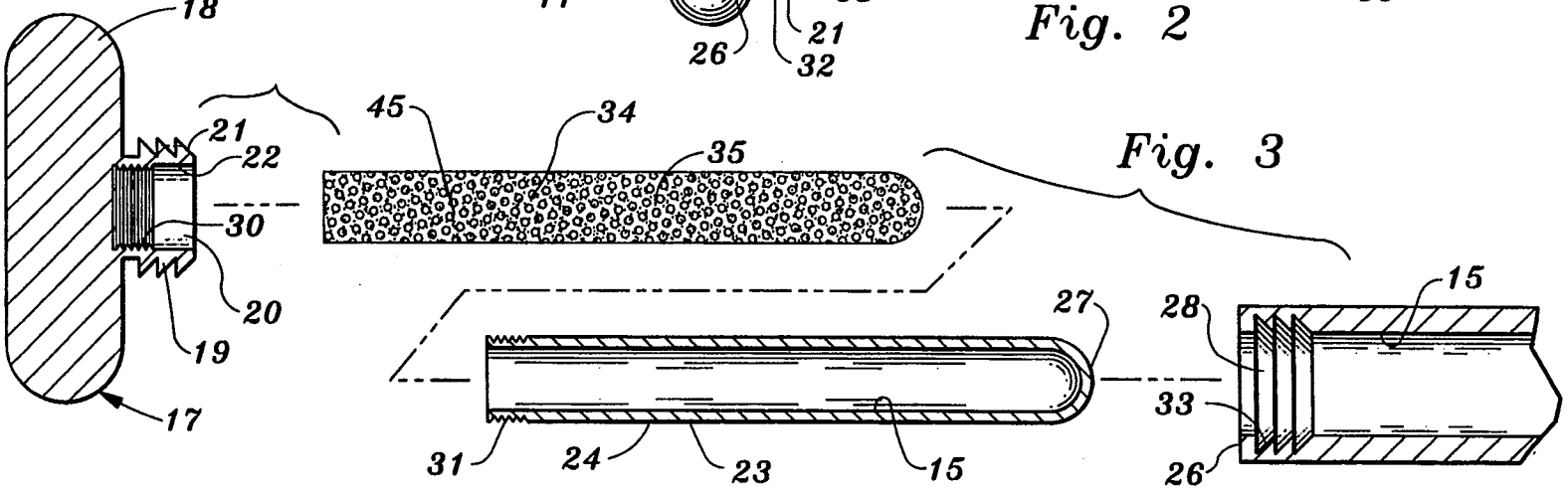
FIG. 3 is an enlarged partial, cross sectional view corresponding to the handle area of such bat and showing the coupling of the knob, handle and tubular member.

In the preferred embodiment of ball bat 10, and as shown in FIGS. 1, 2, and 3, outer surface 21 of elongated portion 19 of detachable knob 17 includes one or more ridges 32, or grooves, threads, barb, or the like, for coupling with one or more corresponding grooves 33, or ridges, threads, barbs, or the like, on inner surface 15 of handle portion 13. Of course, other configurations may have grooves or threads, for example on outer surface 21 and corresponding ridges or barbs on inner surface 15.

Figure 4:
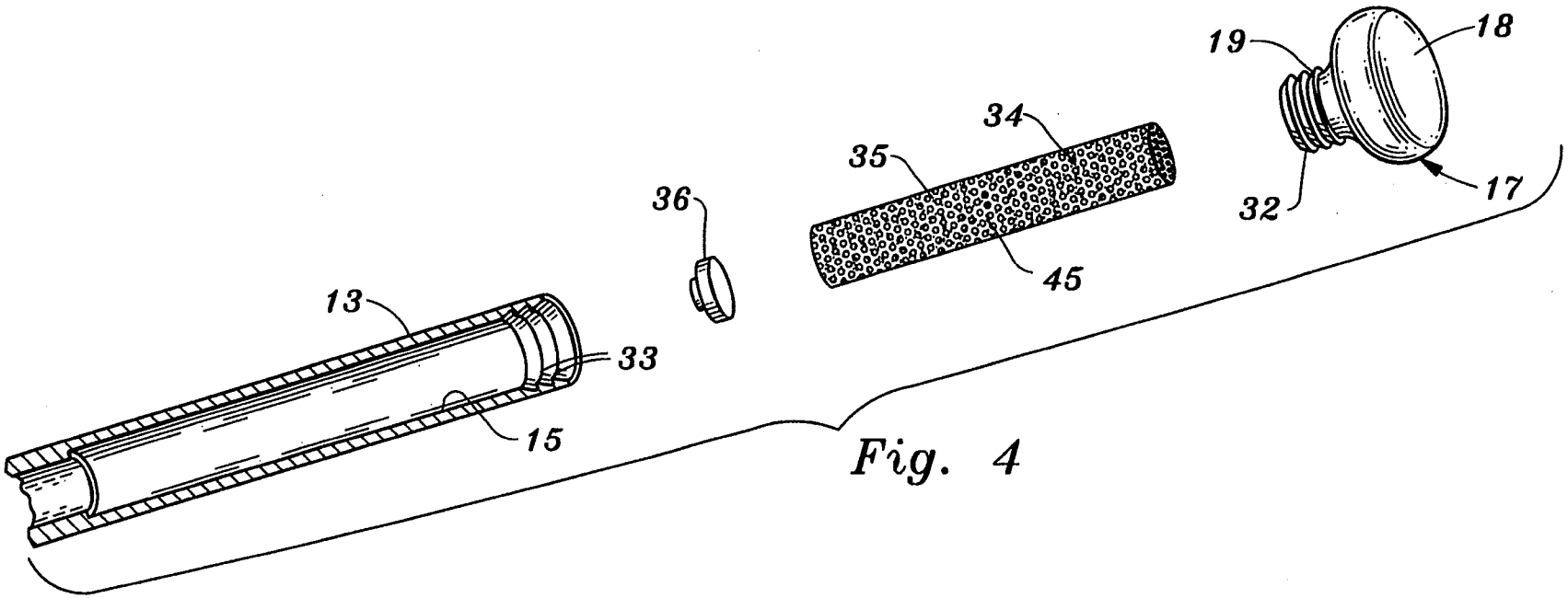
FIG. 4 is an enlarged view of a handle according to another embodiment of the invention where a plug is utilized to close and secure one end of the tubular member, according to the invention.

Referring now to FIGS. 2 and 4, a plug 36 may be used to cap second end 27 of tubular member 23. Alternatively, a tubular member having a sealed end at 27 may be utilized. Plug 36 may be composed of metal, plastic, rubber, or any other durable, fluid impermeable material. Also seen in FIG. 2 is weld 37 which may be used to further secure detachable knob 17 within handle portion 13. Alternatively, or in combination with weld 37, and adhesive 38 may be used to further secure detachable knob 17 in handle portion 13.

Figure 6:
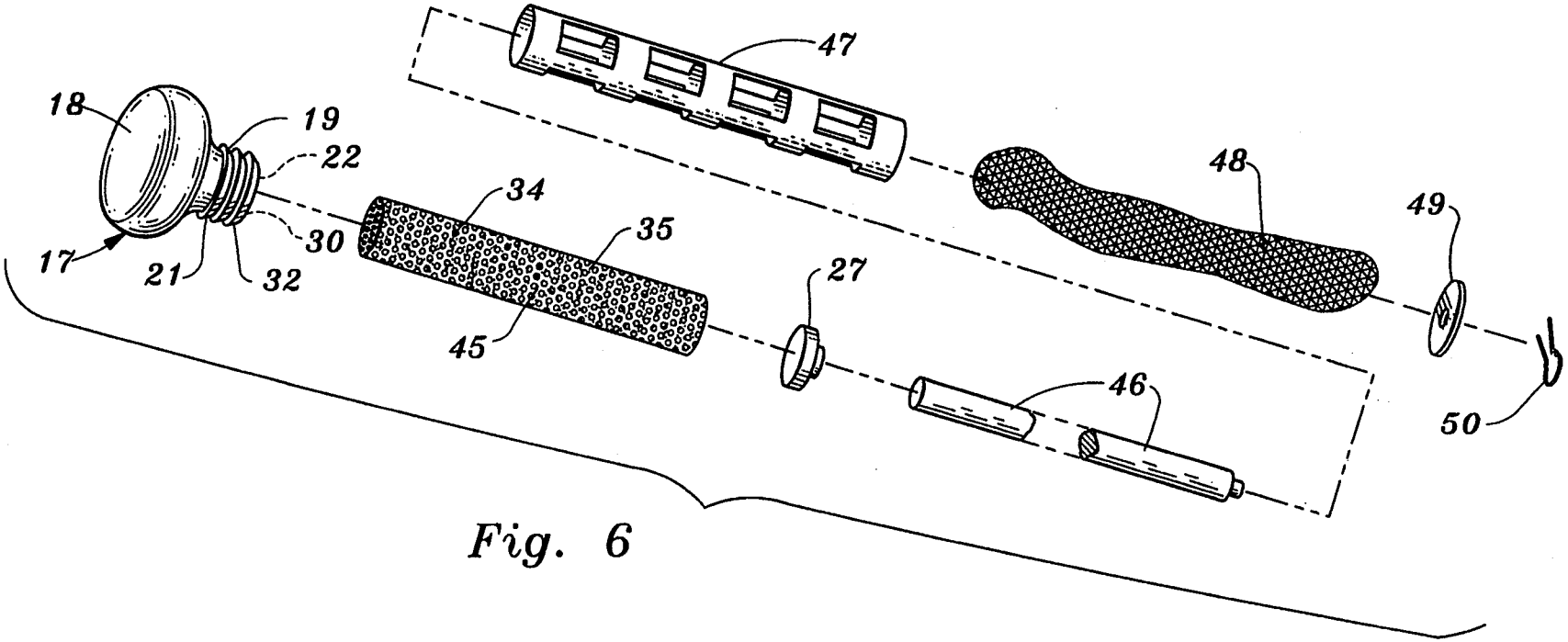
FIG. 6 shows an exploded view of another embodiment of the bat of the present invention including a transfer cylinder, according to the invention.
Figure 7:
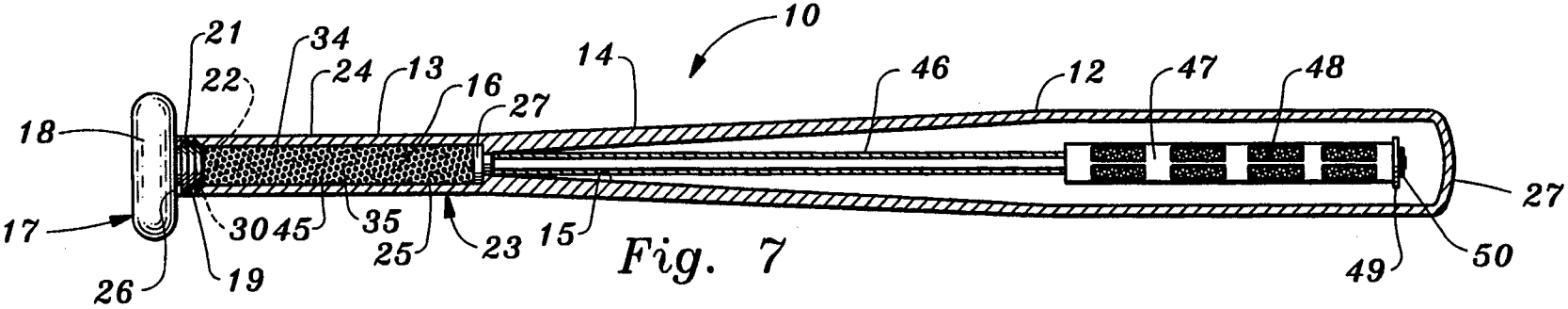
FIG. 7 shows the embodiment of the bat shown in FIG. 6 assembled for use and including a transfer cylinder, according to the invention.

In reference to FIGS. 6 and 7 an embodiment of bat 10 is shown including a shock transfer cylinder 47 inserted into the free end of bat 10. Transfer cylinder 47 is preferably attached to tubular member 23 at second end 27 as shown by rod 46. Rod 46 may be composed of steel, aluminum, plastic, or any other durable resilient material. Rod 46 may be welded, fused, secured by adhesives, screwed, or otherwise mechanically fastened such as with pin 50 and washer 49 to end 27 of tubular member 23. Transfer cylinder 47 is preferably provided either partially or completely filed with aluminum wool, steel wool, or the like, and provides a very efficient shock absorbing means in addition to tubular member 23.

Figure 5:
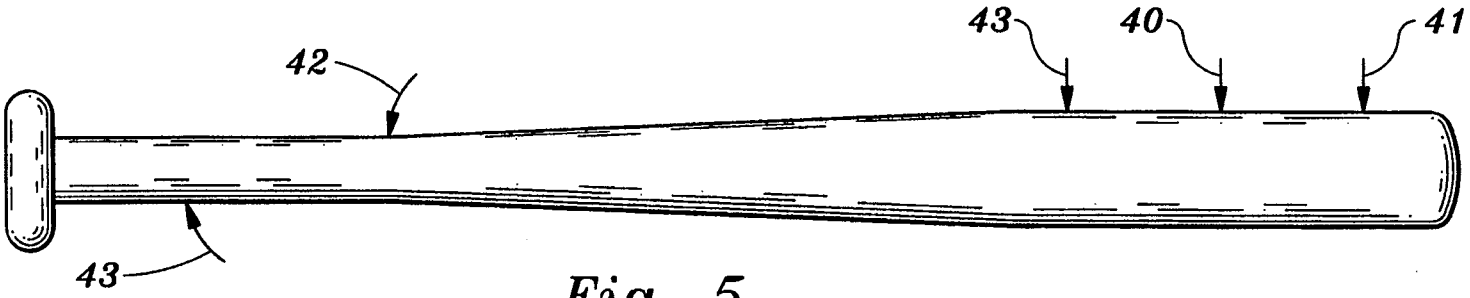
FIG. 5 is a representation of the some of the forces and balance points associated with the implementation of the invention.

In operation and use, bat 10 is very efficient at dampening shocks produced by inaccurate hits as well as enhancing a wide variety of other batting functions. It is believed that such advantages are achieved as herein described, however, no limitations on the scope or breadth of the present invention should be implied therefrom. FIG. 5 illustrates in schematic fashion, an inaccurate impact of bat 10 with a ball 43, which results in a reaction composed of at least three distinct shock components, shock 40 that is essentially parallel to the ball flight and distributed equally along the bat, shock 41 that is parallel to the bat axis, and shock 42 illustrating the torsional or end for end shock component of such inaccurate impact. In general terms, shocks 41 and 42 causes the bat to rotate rapidly about the bat's center of mass 44 and as the distance from the location of shock 42 to the center of mass 44 may be large in proportion to the distance from handle 13 to center of mass 44, the shock delivered to the handle 13 may be very large.

FIG. 5 further illustrates that shock 42 causes handle 13 to rapidly accelerate in a path essentially at a right angle to the long axis of bat 10. When this occurs, the plurality of particles 34 in slurry 45 move about within tube 23. Such movement transfers and attenuates some of the force of shock 42 oven a greater time period than would normally occur. In addition, when the acceleration of handle 13 causes the inside of tube 23 to impact with the plurality of particles 34 in slurry 45, the particles and the fluid transfer of this force is in an essentially random manner since the independent components of the particles careen off one each other and the inner surface of tube 23. This randomization redirects a portion of shock 42 in numerous directions thereby reducing its magnitude in any one direction.

The means and methods herein described for the baseball bat of the present invention may also be installed in any implement subject to torquing shocks, for example, tennis racquets, golf clubs, racquets, carpenter's hammers, and the like.

While the above description contains many specificities, they should not be construed as limitations on the scope of the invention but merely as exemplifications of preferred embodiments thereof. It is understood that the present disclosure has been made only by way of example and that numerous changes in the details of construction may be resorted to without departing from the spirit and scope of the invention. Accordingly the scope of the invention should be determined by the appended claims and their legal equivalents, and not by the examples which have been given.

What is claimed is:

1. A ball bat, comprising:

an elongated body with a free end portion of one diameter tapering to a handle portion of a reduced diameter, said handle portion having an outer surface and an inner surface and a cavity therein; the handle portion including a detachable knob adapted to be secured in said cavity in the handle portion; said detachable knob having an expanded portion and an elongated portion, said elongated portion including a chamber therein; the elongated portion of the detachable knob having an outer surface and an inner surface;

a tubular member having all upper surface and an inner surface inserted into said handle portion of said bat and including a first end and a second end, said first end having an opening therein and including means for securing said tubular member to said detachable knob;

a transfer cylinder operably inserted into said free end portion of said elongated body; said transfer cylinder being attached to the tubular member by fastening means;

a plurality of particles interiorly disposed within said tubular member; and a fluid interiorly situated within said tubular member.

2. The ball bat of claim 1 wherein said fastening means for attaching said transfer cylinder to said tubular member comprises an elongated rod.

3. A ball bat comprising: an elongated body with a free end portion of one diameter tapering to a handle portion of a reduced diameter, said handle portion having an outer surface and all inner surface and a cavity therein; the handle portion including a detachable knob adapted to be secured in said cavity in the handle portion; said detachable knob having an expanded portion and an elongated portion, said elongated portion including a chamber therein; the elongated portion of the detachable knob having an outer surface and an inner surface;

a tubular member having an outer surface and an inner surface inserted into said handle portion of said bat and including a first end and a second end, said first end having an opening therein and including means for securing said tubular member to said detachable knob;

a plurality of particles interiorly disposed within said tubular member; and a fluid interiorly situated within said tubular member.

4. The ball bat of claim 3 wherein said means for securing said tubular member to said detachable knob comprises one or more grooves within said chamber of said detachable knob and a corresponding set of ridges on said outer surface of said tubular member for coupling with said plurality of grooves within the chamber of the detachable knob.

5. The ball bat of claim 3 wherein said means for securing said tubular member to said detachable knob comprises one or more ridges within said chamber of said detachable knob and a corresponding set of grooves on said outer surface of said tubular member for coupling with said plurality of grooves within the chamber of the detachable knob.

6. The ball bat of claim 3 wherein said outer surface of said elongated portion of said detachable knob further includes one or more ridges for coupling with one or more corresponding grooves on said inner surface of said handle portion.

7. The ball bat of claim 3 wherein said outer surface of said elongated portion of said detachable knob further includes one or more grooves for coupling with one or more ridges on said inner surface of said handle portion.

8. The ball bat of claim 3 wherein said second end of the tubular member is capped with a plug.

9. The ball bat of claim 3 wherein said detachable knob is further secured within said handle portion by welds.

10. The ball bat of claim 3 wherein said detachable knob is further secured within said handle portion by adhesives.

11. The ball bat of claim 3 wherein said plurality of particles each include projections therefrom resulting in a jack or a star-like configuration.

12. The ball bat of claim 3 wherein said particles are flake-like.

13. The ball bat of claim 3 wherein said fluid includes an oil.

14. The ball bat of claim 3 wherein said particles are freely flowable.

* * * * *